US011680422B2

(12) United States Patent
Lowrey

(10) Patent No.: US 11,680,422 B2
(45) Date of Patent: Jun. 20, 2023

(54) FENCING APPARATUS AND FENCING TECHNIQUES

(71) Applicant: WIREMAN PTY LIMITED, Milsons Point (AU)

(72) Inventor: Ian Lowrey, Surry Hills (AU)

(73) Assignee: WIREMAN PTY LIMITED

( * ) Notice: Subject to any disclaimer, the term of this patent is extended or adjusted under 35 U.S.C. 154(b) by 222 days.

(21) Appl. No.: 17/275,785

(22) PCT Filed: Sep. 4, 2019

(86) PCT No.: PCT/AU2019/050939
§ 371 (c)(1),
(2) Date: Mar. 12, 2021

(87) PCT Pub. No.: WO2020/051630
PCT Pub. Date: Mar. 19, 2020

(65) Prior Publication Data

US 2022/0040833 A1 Feb. 10, 2022

(30) Foreign Application Priority Data

Sep. 14, 2018 (AU) ..... 2018903459
Mar. 7, 2019 (AU) ..... 2019900744

(51) Int. Cl.
*E04H 17/10* (2006.01)
*E04H 17/02* (2006.01)
*B25B 25/00* (2006.01)

(52) U.S. Cl.
CPC ..... *E04H 17/124* (2021.01); *B25B 25/00* (2013.01); *E04H 17/127* (2021.01)

(58) Field of Classification Search
CPC ..... F16G 11/04; F16G 11/044; F16G 11/046; F16G 11/048; B25B 25/00; E04H 17/127;
(Continued)

(56) References Cited

U.S. PATENT DOCUMENTS 606,420 A * 6/1898 Kitselman ..... E04H 17/266 140/17
639,521 A * 12/1899 Carpenter ..... E04H 17/268 254/248

(Continued)

FOREIGN PATENT DOCUMENTS

AU 2008203804 A1 2/2009
AU 2017204418 A1 1/2018

(Continued)

OTHER PUBLICATIONS

Australian Patent Office, The International Search Report and The Written Opinion of the International Searching Authority, dated Nov. 7, 2019, for International Application No. PCT/AU2019/050939.

*Primary Examiner* — Jonathan P Masinick
(74) *Attorney, Agent, or Firm* — Design IP

(57) ABSTRACT

A parallelogram wire gripping apparatus (150, 250) is disclosed. There is a pair of distal arms (151, 152, 251, 252) and a pair of proximal arms (153, 154, 253, 254). The distal ends of the distal arms are pivoted to each other and are shaped to form a wire clamp (165). Each proximal end of the distal arms is pivoted to a corresponding distal end of the proximal arms. Each proximal arm is pivoted together at a midpoint thereof. A spring (130, 230) urges the wire clamp closed. A wire gripping jaws arrangement (165) incorporating fasteners (171, 172, 173) is also disclosed. A wire strainer incorporating two grippers (141, 142), a chain (144) and a winch (143) is also disclosed.

13 Claims, 14 Drawing Sheets

(58) Field of Classification Search
CPC ... E04H 17/131; E04H 17/261; E04H 17/266; E04H 17/268
See application file for complete search history.

(56) References Cited

U.S. PATENT DOCUMENTS

| | | | | |
|---|---|---|---|---|
| 1,408,622 | A | 3/1922 | Curtis | |
| 2,227,893 | A * | 1/1941 | Benjamin | F16G 11/12 254/120 |
| 2,611,397 | A | 9/1952 | Limpus | |
| 2,653,498 | A | 9/1953 | Truesdell | |
| 4,313,333 | A | 2/1982 | Malagnoux et al. | |
| 11,092,212 | B2 * | 8/2021 | Fox | F16G 11/12 |
| 2022/0220769 | A1 * | 7/2022 | Suehs | E04H 17/268 |

FOREIGN PATENT DOCUMENTS

| | | | |
|---|---|---|---|
| CN | 107178579 | A | 9/2017 |
| CN | 206685674 | U | 11/2017 |
| DE | 102013111211 | A1 | 4/2015 |
| FR | 2616110 | A1 * | 12/1988 |
| WO | 2018090079 | A1 | 5/2018 |

* cited by examiner

FENCING APPARATUS AND FENCING TECHNIQUES

FIELD OF THE INVENTION

The present invention relates to fencing, and in particular, to fencing apparatus which is of assistance to fencers in constructing new fencing, and farmers in repairing existing fencing.

BACKGROUND ART

The potential capabilities, and actual performance, of modern fencing have been much improved by the introduction of high tensile wire due to its ability to hold a considerable strain without stretching. For example, low tensile wires such as "soft" malleable fencing wire and similarly malleable wires such as bailing wire, typically have a yield strength in the range of approximately 350-550 MPa. Similarly, low tensile fencing wire is typically installed at a tension of approximately 1 kN and has a breaking strain of approximately 3 kN.

By contrast, high tensile fencing wire has a yield strength of approximately 1650 MPa and an ultimate strength of 1860 MPa. Such high tensile fencing wires are installed with a tension of approximately 2 kN and have a breaking strain of approximately 8 kN. However, this strength advantage comes with an associated disadvantage in that the wire is not at all malleable, being very stiff and hard to bend. Whilst professional fencers who are bending high tensile wire repeatedly during their working day develop strong fingers and tough skin, this is not necessarily the case for others who may need to repair a fence only occasionally.

Fences generally take the form schematically illustrated in FIG. 1, and in such a fence any of the horizontally extending wires is liable to be broken by farm animals, wildlife, feral animals, and the like. In the event of such breakages it is necessary for the fence to be repaired, and in particular, be re-strained. Unless the fence can be re-strained to a tension approaching its original condition, the repair is not likely to be as effective as desired.

Genesis of the Invention

The genesis of the present invention is a desire to provide fencing apparatus and fencing techniques which can be of assistance in relation to the creating and maintaining of fences utilising high tensile wire.

SUMMARY OF THE INVENTION

In accordance with a first aspect of the present invention there is disclosed a parallelogram wire gripping apparatus for use in wire straining, said apparatus comprising a pair of distal arms and a pair of proximal arms, the distal ends of the distal arms being pivoted to each other and shaped to form a wire clamp, each proximal end of the distal arms being pivoted to a corresponding distal end of the proximal arms, each proximal arm being pivoted together at a midpoint thereof, a spring interconnecting said proximal arms at a location intermediate said distal ends of said proximal arms and said midpoints, and urging said wire clamp closed, and said proximal arms extending beyond said midpoints in opposite directions to form a pair of graspable plier-like handles which when moved against the action of said spring opens said wire clamp.

In accordance with another aspect of the present invention there is disclosed a wire gripping jaws apparatus for holding a wire during straining, said apparatus comprising a pair of arms pivoted together and movable to clamp and un-clamp a length of wire, wherein one of said arms has a pair of spaced apart first fastener parts secured thereto and forming a bight opposite the other of said arms, whereby said arms are movable to position said wire between said first fastener parts and thereby clamp said wire in said bight.

BRIEF DESCRIPTION OF THE DRAWINGS

Some embodiments of the invention will now be described, by way of example only, with reference to the accompanying drawings in which.

DETAILED DESCRIPTION

Figure 1:
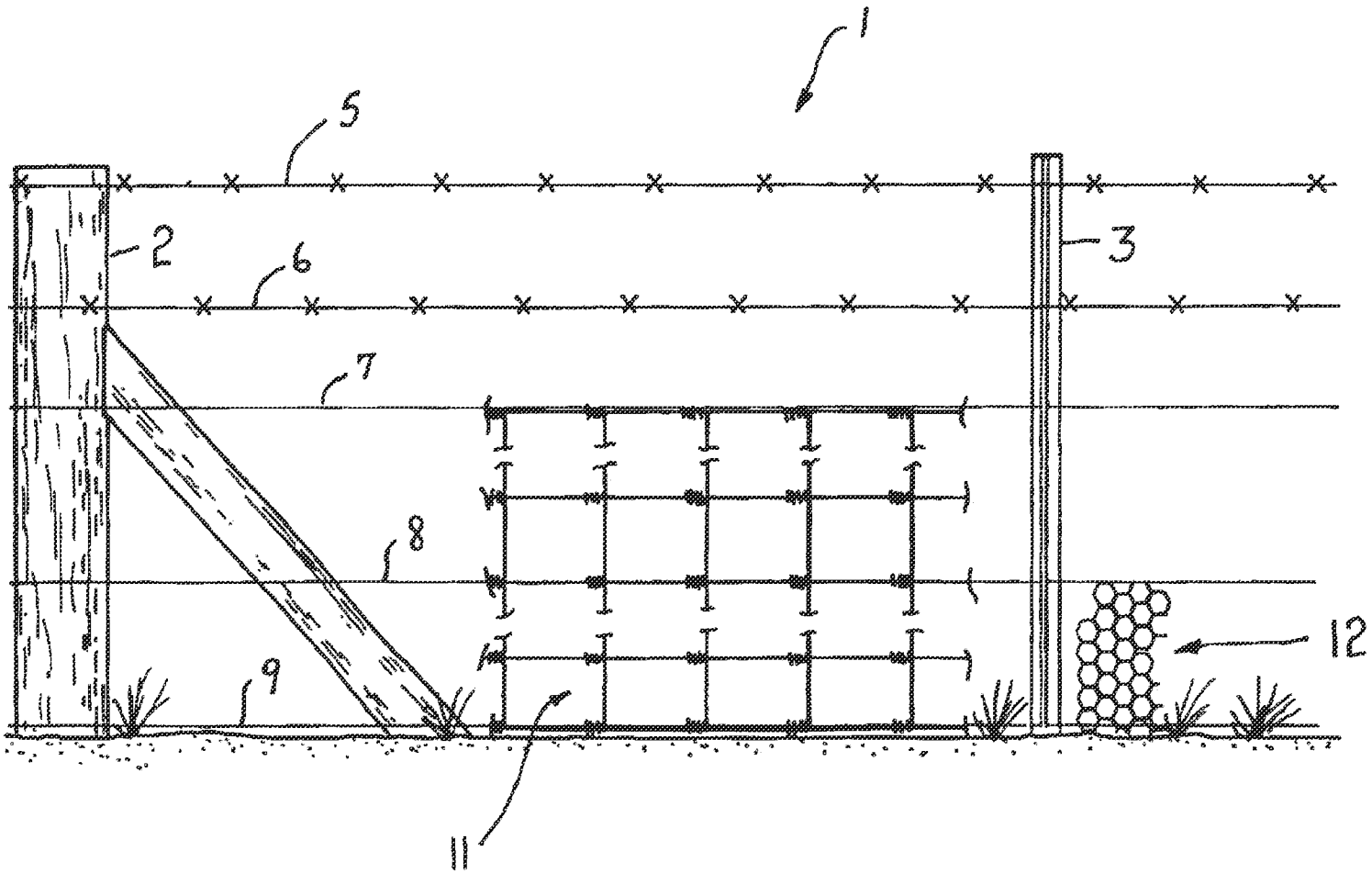
FIG.1 PRIOR ART
FIG. 1 is a schematic side elevation of a typical conventional fence known to the prior art.

As seen in FIG. 1, a typical fence 1 takes the form of a strainer post 2 and star pickets 3. A typical arrangement consists of two upper wires 5, 6 of barb wire, and up to three wires which support hinge lock 11, ring lock or similar wire mesh materials. These three wires are respectively a top wire 7, a belly wire 8 and a bottom wire 9. The hinge lock 11 typically has eight horizontal wires with the uppermost wire being clipped to the top wire 7, the bottommost wire being clipped to the bottom wire 9, and one of the intermediate wires being clipped to the belly wire 8.

As an addition to, or an alternative to, the hinge lock 11, wire netting 12 can be used, particularly if a rabbit proof fence is desired.

It will be apparent that any of the horizontally extending wires of the fence 1 can be broken by stock, wildlife, or feral animals. Somewhat paradoxically, the bottom wire 9 is often broken by kangaroos which push under the fence 1, notwithstanding their ability to jump over the fence 1 if they felt so inclined. Once the bottom wire 9 is broken by a kangaroo or wild pig, then a passage becomes established and this can lead to the misplacement or even loss of sheep, calves, etc. by their passing through the fence 1.

Figure 2A:
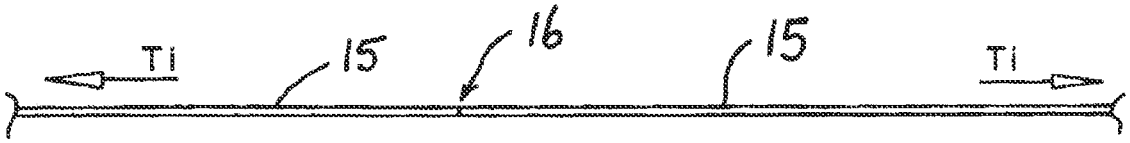
FIGS. 2A-2F illustrate the prior art steps involved in repairing a break in a wire of a typical fence.
Figure 2B:
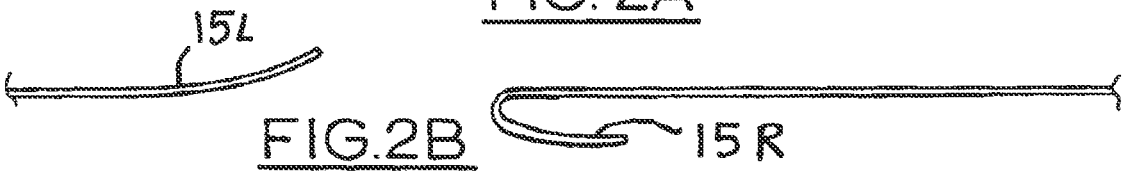

Turning now to FIGS. 2A-2F, the steps involved hitherto in repairing a broken wire 15 are illustrated. FIG. 2A shows the wire 15 in its unbroken state with the location of the prospective break being indicated at 16. The initial tension in the wire 15 is indicated as Ti. FIG. 2B illustrates the broken wire 15 after the break has occurred, there being two ends 15L and 15R created respectively on the left and the right side of the break location 16.

Figure 2C:
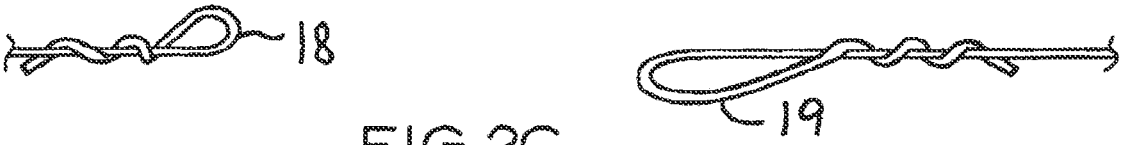

As seen in FIG. 2C, the first step in repairing the break is to form two loops 18, 19 by folding the wire ends 15L and 15R respectively back on themselves and twisting the free end of the wire back upon the remainder of the wire. This is done by hand by a person with strong fingers, and is done by hand using a pair of pliers otherwise.

Figure 2D:
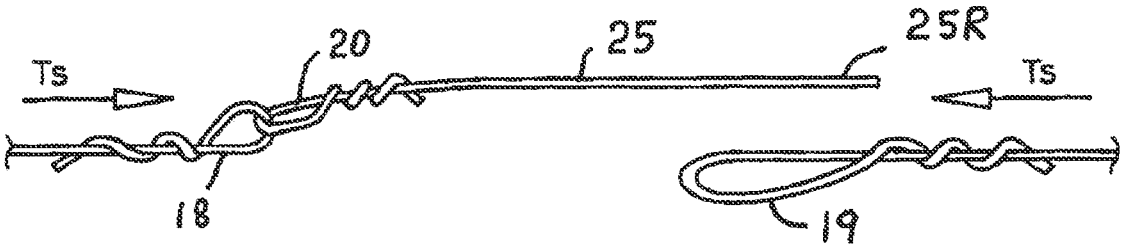
Figure 2E:
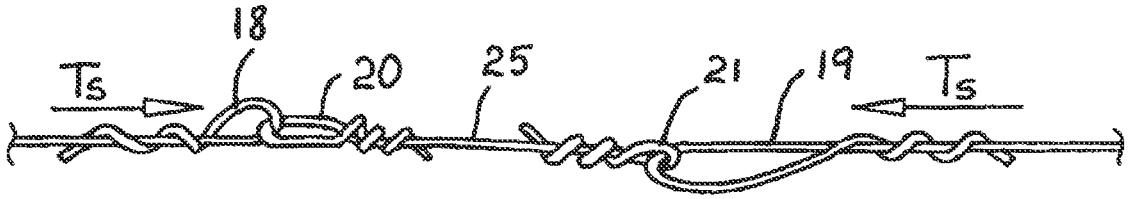

As schematically illustrated in FIG. 2D, once the loops 18, 19 have been prepared, the wire 15 is then strained using a pair of wire strainers to essentially restore the tension in the wire strand 15. As indicated in FIG. 2D, the tension after straining is indicated as Ts which is substantially equal to the initial tension Ti as indicated in FIG. 2A. Alternatively, the wires can strained and then the loops 18, 19 are formed.

Irrespective of which sequence is used, a third loop 20 is then formed in a bearer wire 25 and the free end 25R of the bearer wire 25 is then passed through the loop 19.

At this stage, it is then necessary to pull the bearer wire 25 to the right as hard as possible and kink the free end 25R through at least 90° so as to form the beginning of a fourth loop 21. Since the loops 18 and 20 are abutting, the object of this bending exercise is to ensure, as far as practical, that the ends of the loops 21 and 19 are abutting also. This leads to the situation illustrated in FIG. 2E where the four loops 18-21 have been formed. However, the bearer wire 25 is at this stage not under any significant tension, and is generally under no tension at all.

Figure 2F:
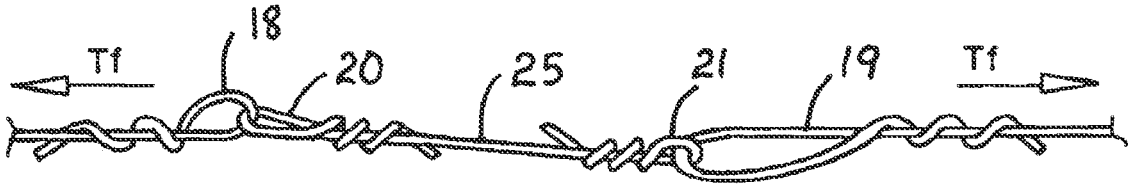
FIG.2F PRIOR ART

What follows is the situation illustrated in FIG. 2F. The break in the wire 15 is considered repaired at the stage illustrated in FIG. 2E, and therefore the wire strainer is removed. As a consequence, there is a final tension Tf in the wire which is always less than the strained tension Ts because of the need to create tension in the bearer wire 25. As a result, the prior art repair results in the repaired fence being less effective than the fence was initially before the break.

Figure 3:
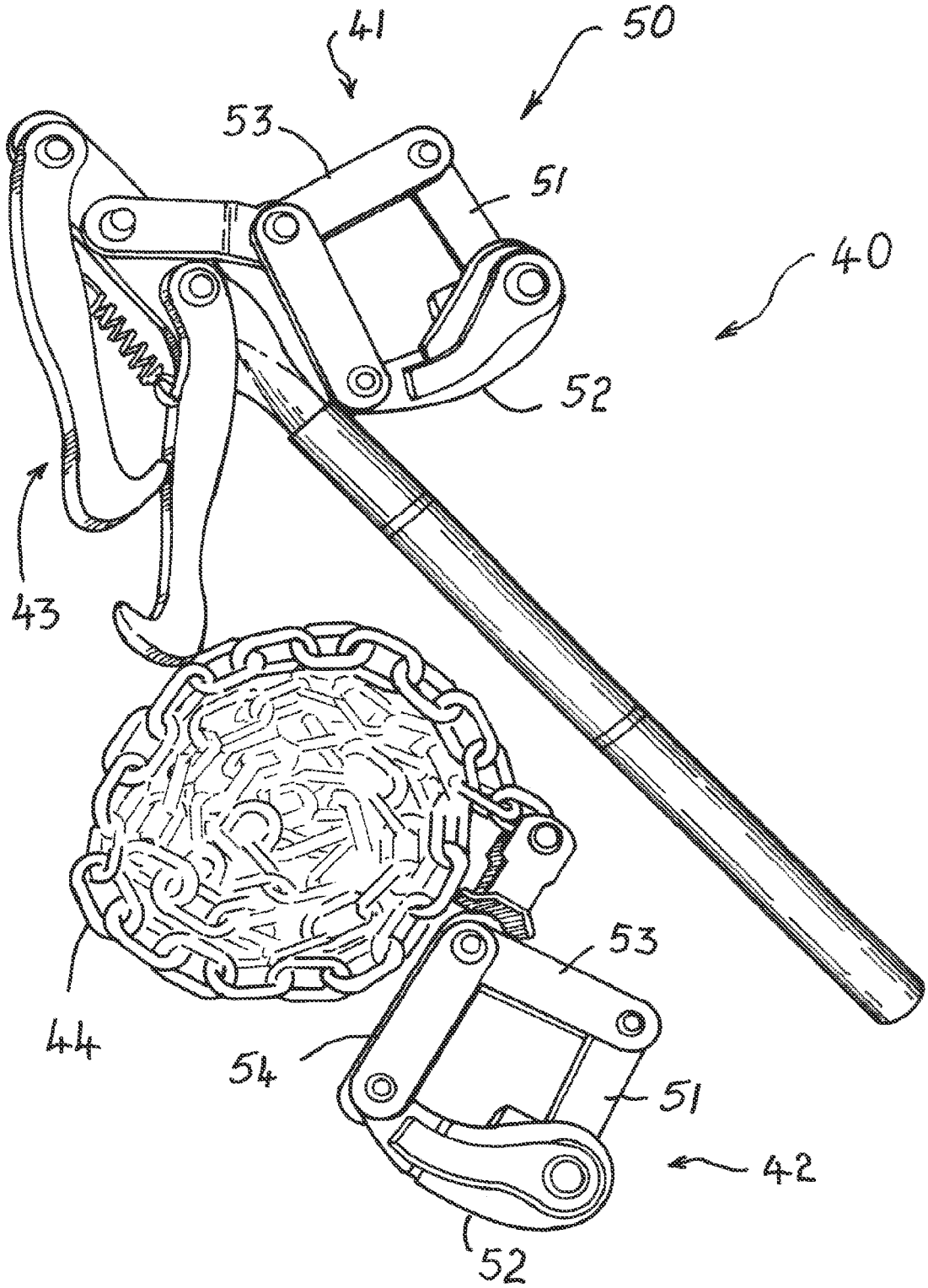
FIG. 3 PRIOR ART
FIG. 3 illustrates the HAYES (Trade Mark) fencing wire strainer which has been used for many years.

Turning now to FIG. 3, a prior art strainer 40 which has been in use for many years in Australia is illustrated. The strainer 40 utilises two wire clamps 41, 42 which are respectively connected to a chain walking pawl arrangement 43 and a chain 44. Each of the wire clamps 41, 42 utilises a conventional parallelogram wire gripping apparatus 50 having a pair of distal arms 51, 52 and a pair of proximal arms 53, 54.

Figure 4:
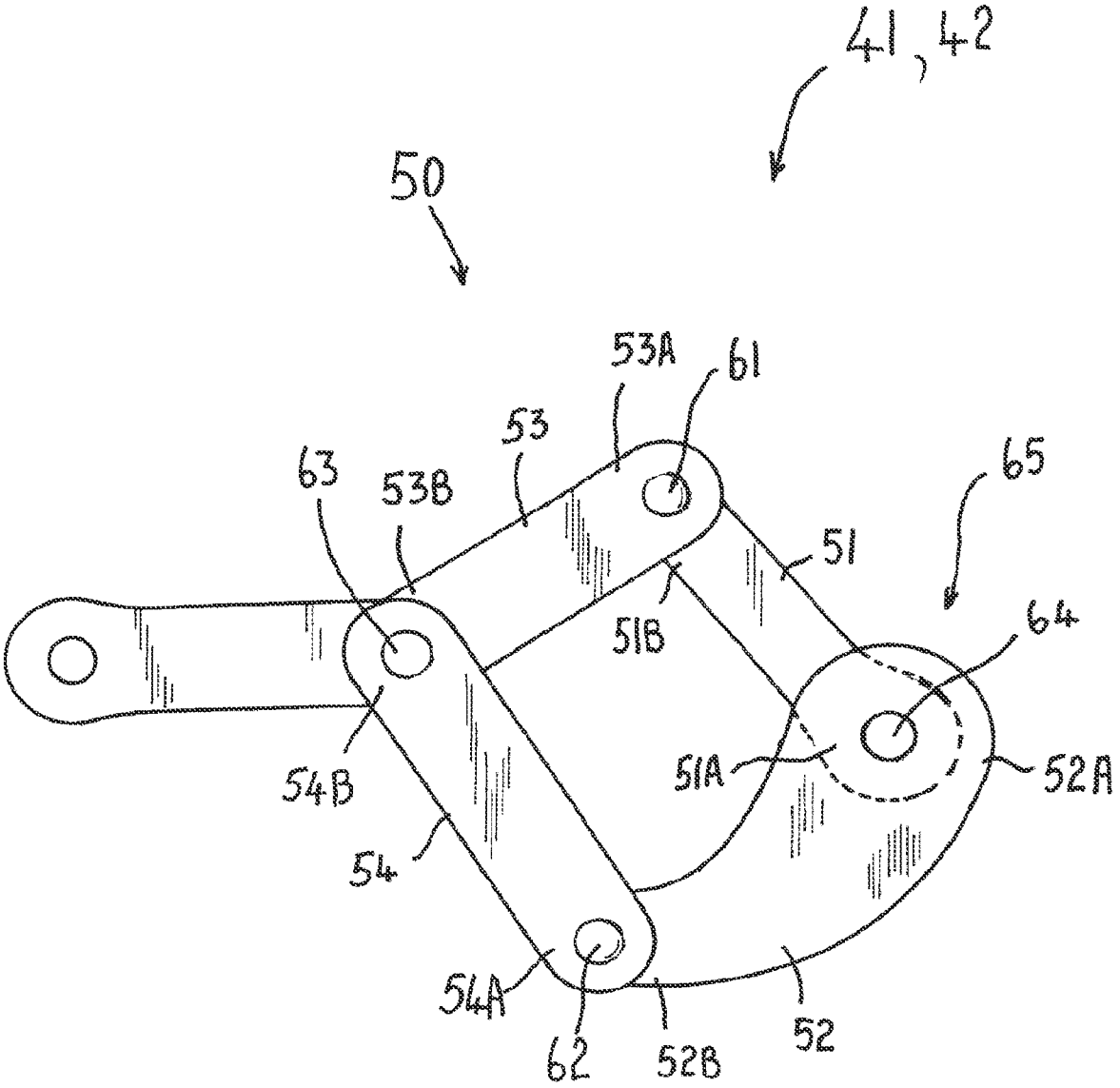
FIG. 4 PRIOR ART
FIG. 4 is a schematic illustration of the arms of the parallelogram wire gripping apparatus of FIG. 3.

As seen in FIG. 4, the proximal ends 51B and 52B of the distal arms 51, 52 are pivoted at 61 and 62 to the corresponding distal ends 53A and 54A of the proximal arms 53, 54. The proximal arms 53, 54 are pivoted together at 63 at their proximal ends 53B and 54B. Similarly, the distal ends 51A and 52A of the distal arms 51, 52 are pivoted together at 64.

The distal ends 51A and 52A are shaped so as to provide a gripping jaws arrangement 65. Manually pushing the pivots 61 and 62 towards each other opens the jaws 65 to permit insertion or removal of fencing wire. Pulling the pivots 63, 64 away from each other, as happens in the straining operation, closes the jaws 65 so as to grip the fencing wire. The difficulty with this manual operation is that the jaws 65 can open unintentionally and fall off the wire.

In an effort to overcome this problem, it is known from Australian Standard Patent Application No 2017 261 464 (to which Australian Innovation Patent No 2017 101 598 corresponds) to replace the proximal arms 53, 54 with a V-shaped torsion spring (461, 561) which urges the proximal ends 51B and 52B of the distal arms 51, 52 apart so as to provide a clamping mechanism. The clamping mechanism is released by compressing the two arms (462, 463; 562, 563) of the torsion spring towards each other. This provides a clamping mechanism that can be activated with a gloved hand, but suffers from the disadvantage that during straining the wire tension passes through the torsion spring. As a consequence, the torsion spring deflects and so the strain applied to the fencing wire is not at a maximum.

Figure 5:
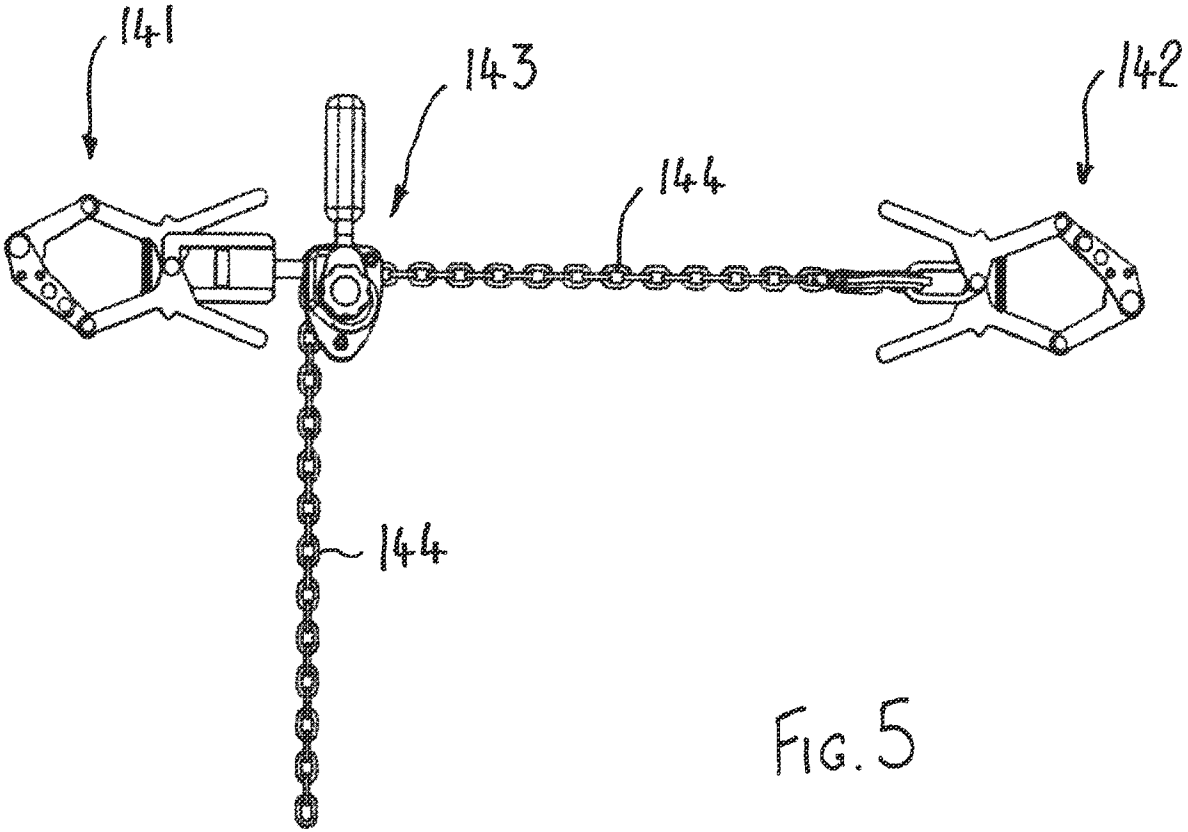
FIG. 5 is a schematic illustration of the wire strainer of the preferred embodiment.

Turning now to FIG. 5, illustrated therein is the wire strainer of the preferred embodiment which incorporates two wire clamps 141, 142; a chain 144 and a winch 143 which replaces the chain walking pawl arrangement 43 of the prior art.

Figure 10:
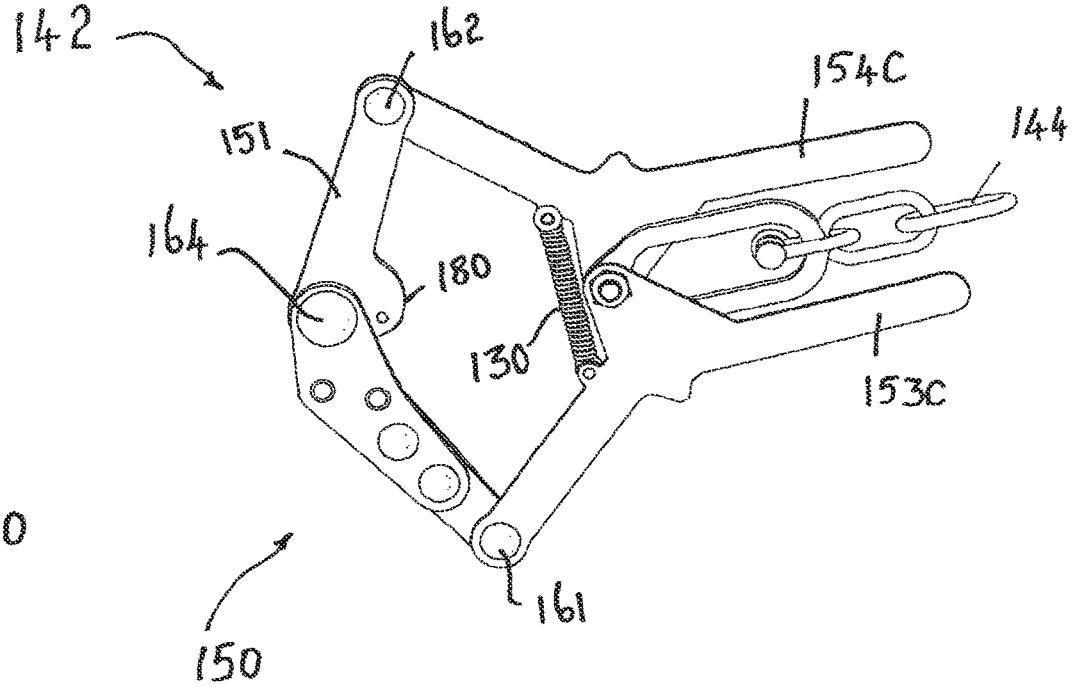
FIG. 10 illustrates the other side of a second wire clamp of the preferred embodiment with the clamp open.
Figure 11:
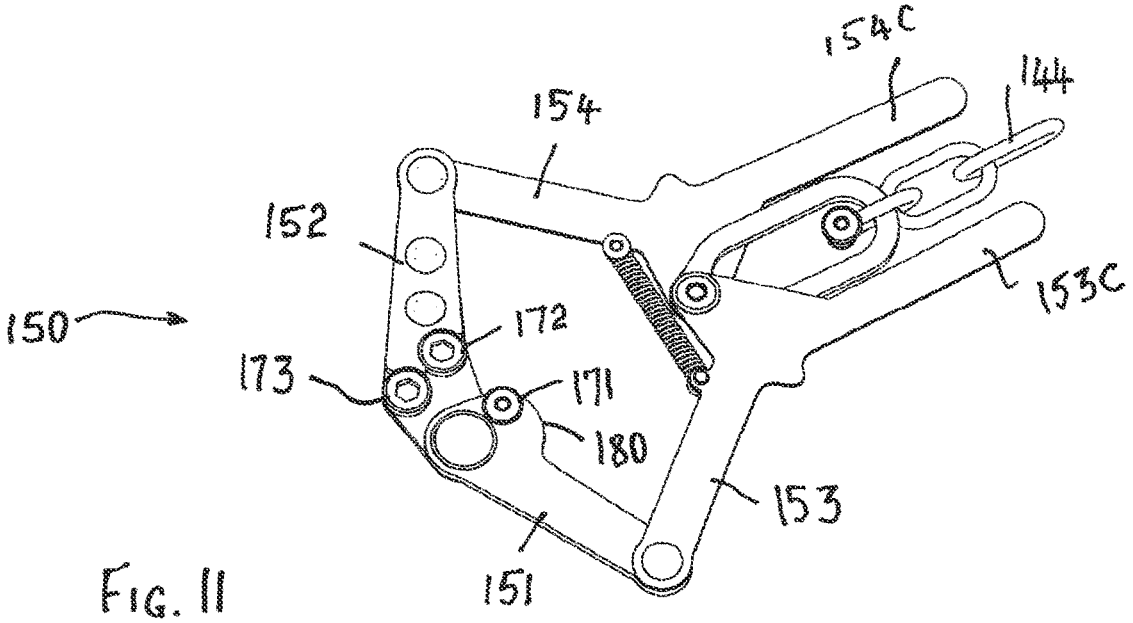
FIG. 11 illustrates the one side of the second clamp of FIG. 10 with the clamp open.
Figure 12:
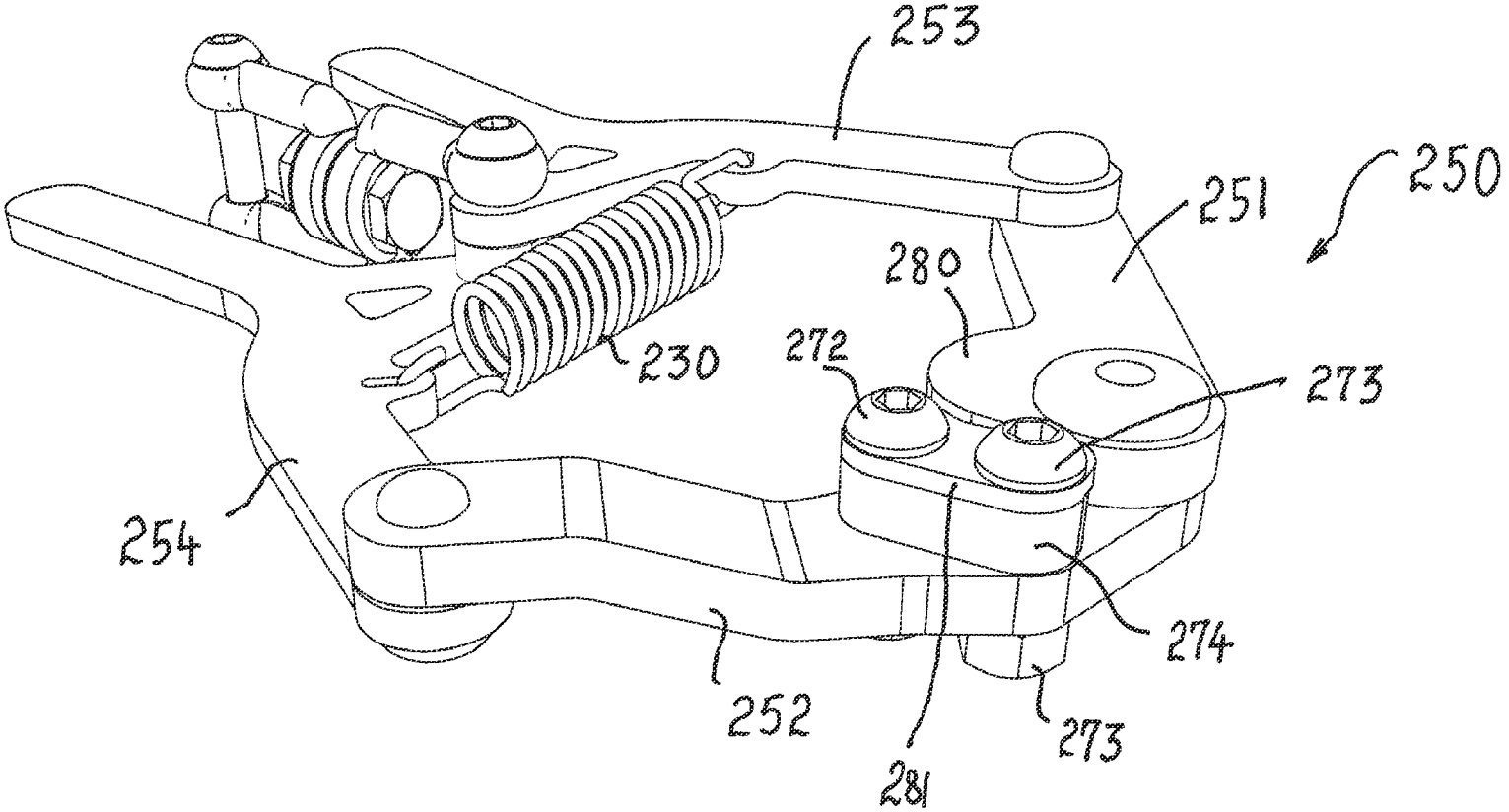
FIG. 12 is a perspective view of a wire gripper of a second embodiment.
Figure 13:
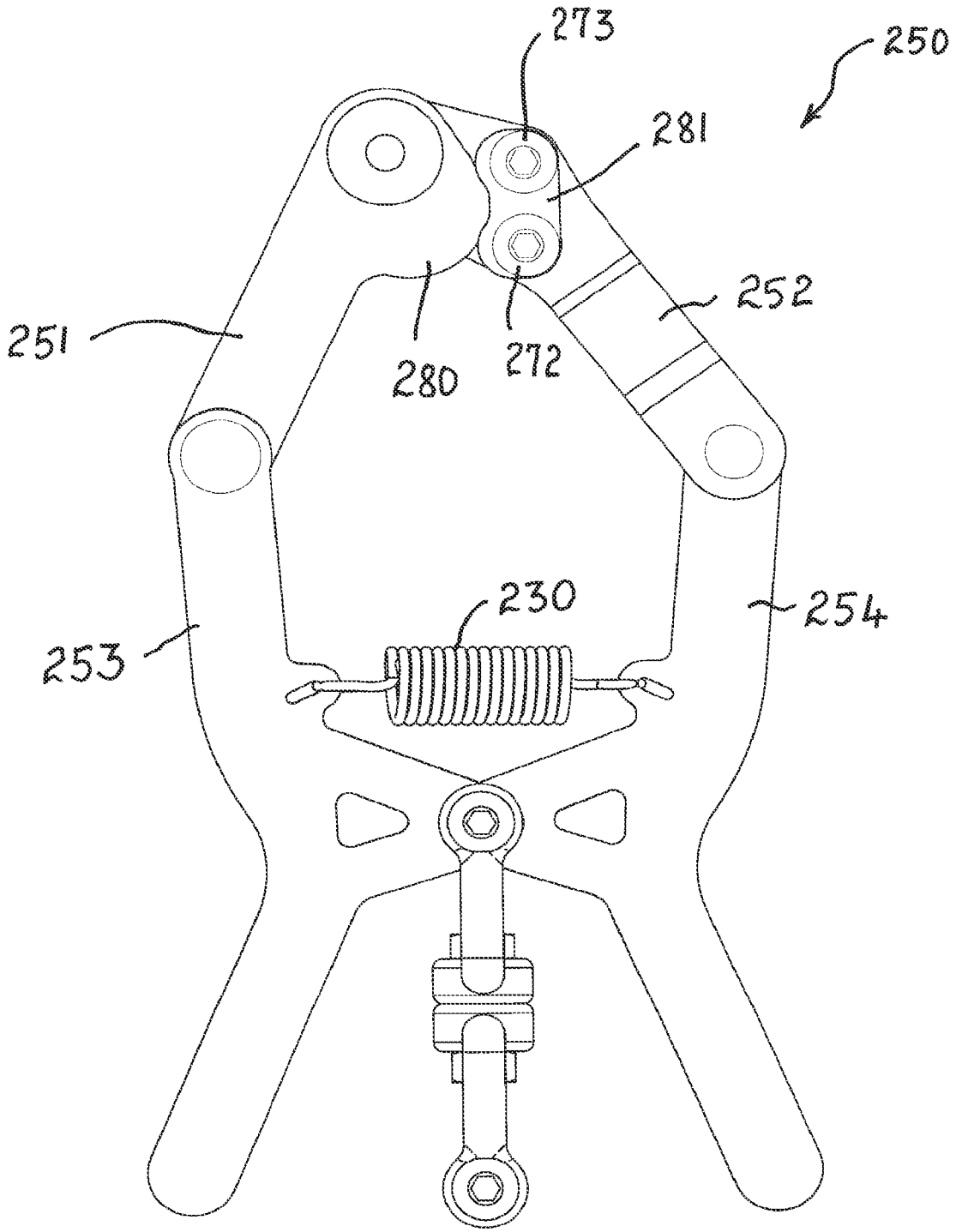
FIG. 13 is a plan view of the wire gripper of FIG. 12 with the jaws closed.
Figure 14:
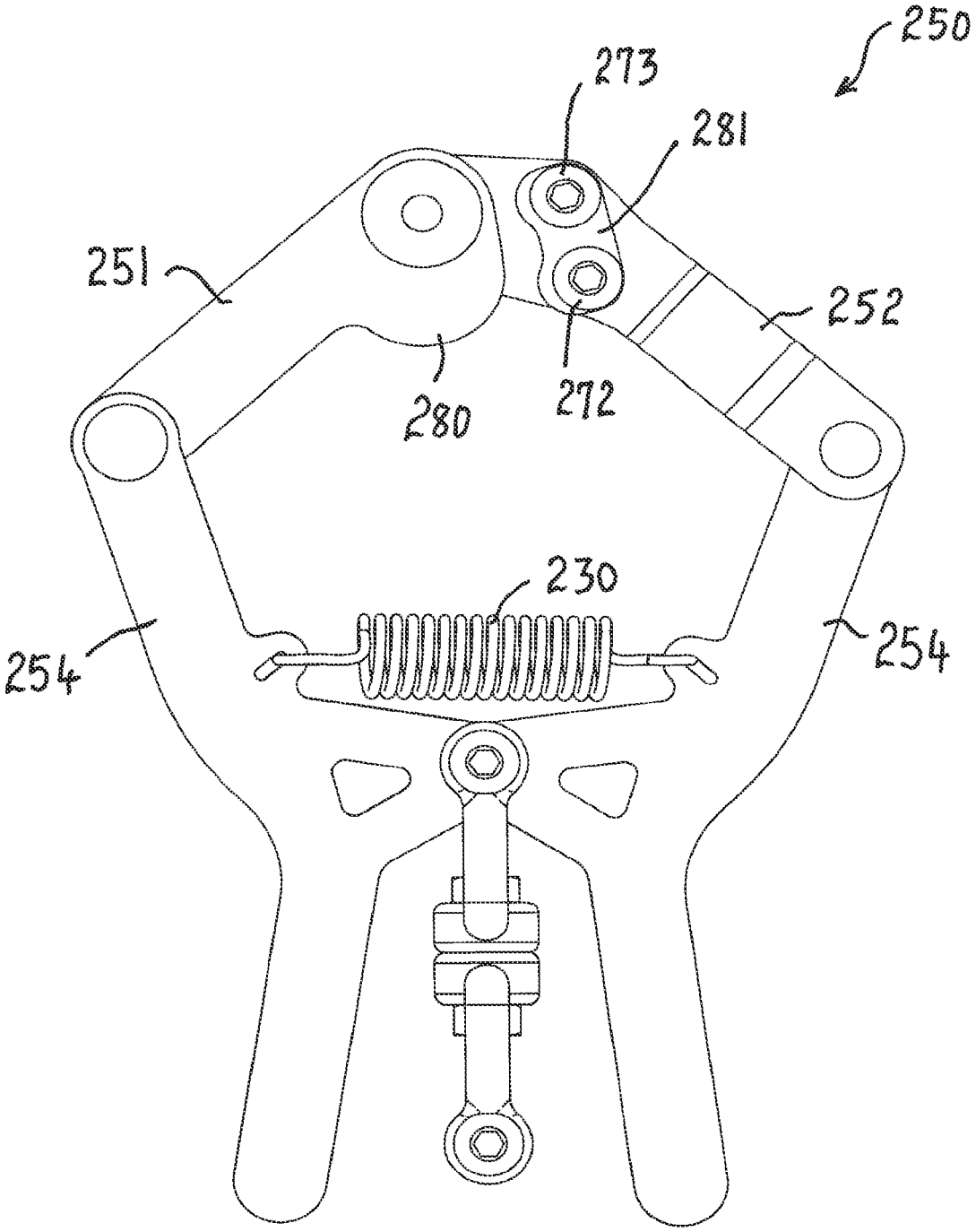
FIG. 14 is a plan view of the wire gripper of FIG. 12 with the jaws open.
Figure 15:
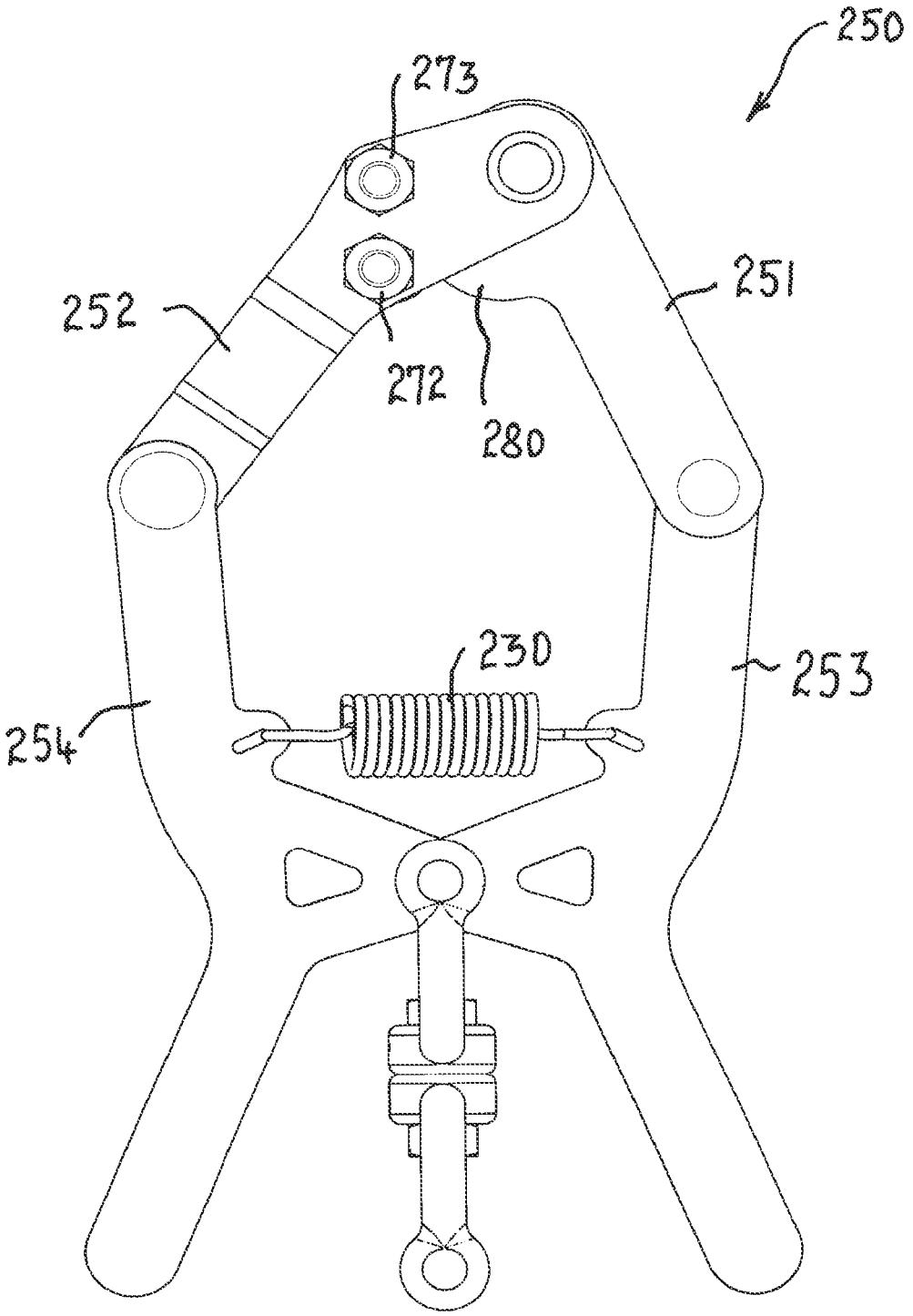
FIG. 15 is an inverted plan view of the wire gripper of FIG. 12 with the jaws closed.
Figure 16:
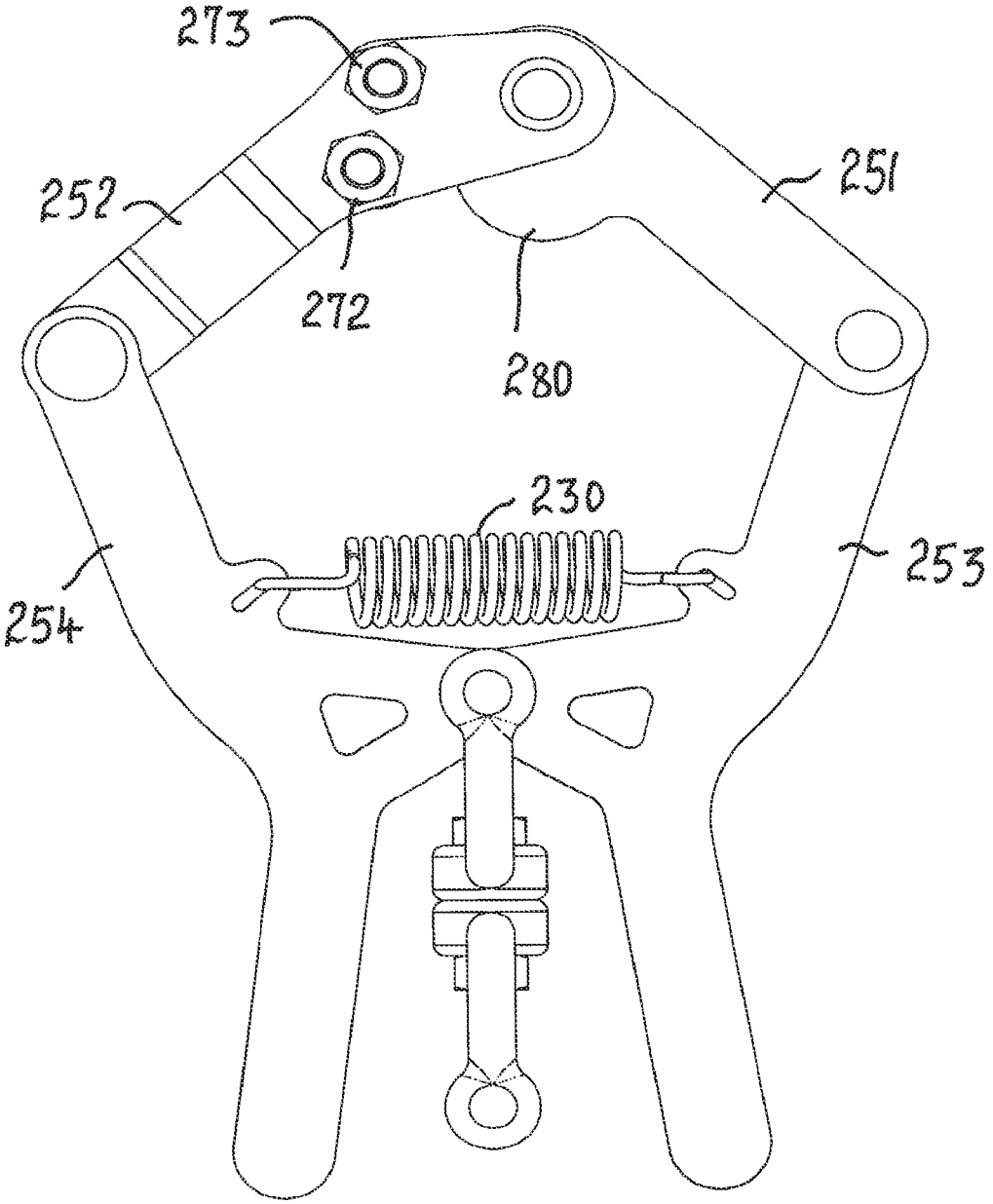
FIG. 16 is an inverted plan view of the wire gripper of FIG. 12 with the jaws open.
Figure 17:
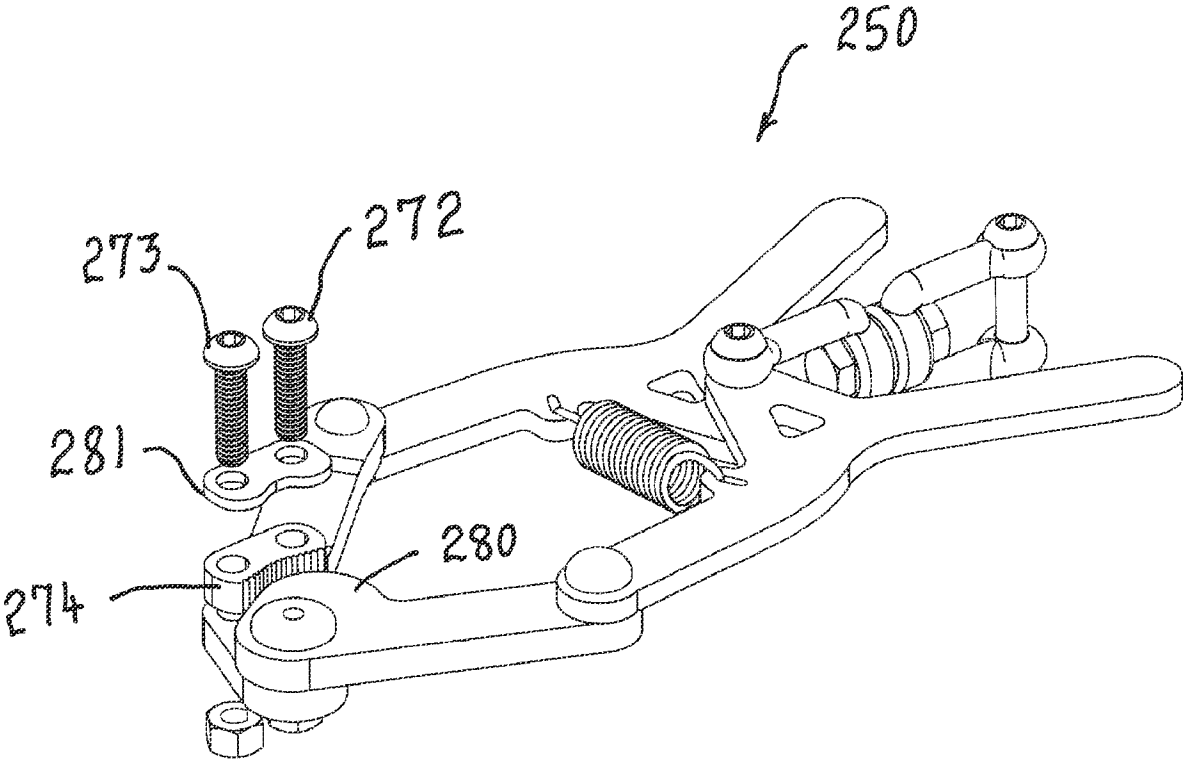
FIG. 17 is an exploded perspective view of the wire gripper of FIG. 12.

As seen in FIGS. 6-9, the wire clamp 141 preferably includes a tension gauge 140 which is in turn connected to the winch 143. As seen in FIGS. 10 and 11, the wire clamp 142 is connected to the chain 144.

The wire clamps 141-142 illustrated in FIGS. 6-11 incorporate a basic parallelogram wire gripping apparatus 150 having two distal arms 151, 152 and two proximal arms 153, 154. The two distal arms 151, 152 are pivoted together at 164 to provide wire gripping jaws 165 (to be described hereafter in more detail). The two proximal arms 153, 154 are pivoted together at 163 which pivot also provides the connecting link between the tension gauge 140 or the chain 144.

As before, the distal arm 151 and proximal arm 153 are pivoted together at 161, and the distal arm 152 and proximal arm 154 are pivoted together at 162. An important difference with the prior art is that the proximal arms 153, 154 are each provided with an arm extension 153C and 154C. In addition, a helical tension spring 130 extends between the two proximal arms 153, 154 between the pivots 161, 162 on the one side, and the pivot 163 on the other side. However, the tension spring 130 is relatively close to the pivot 163.

Figure 6:
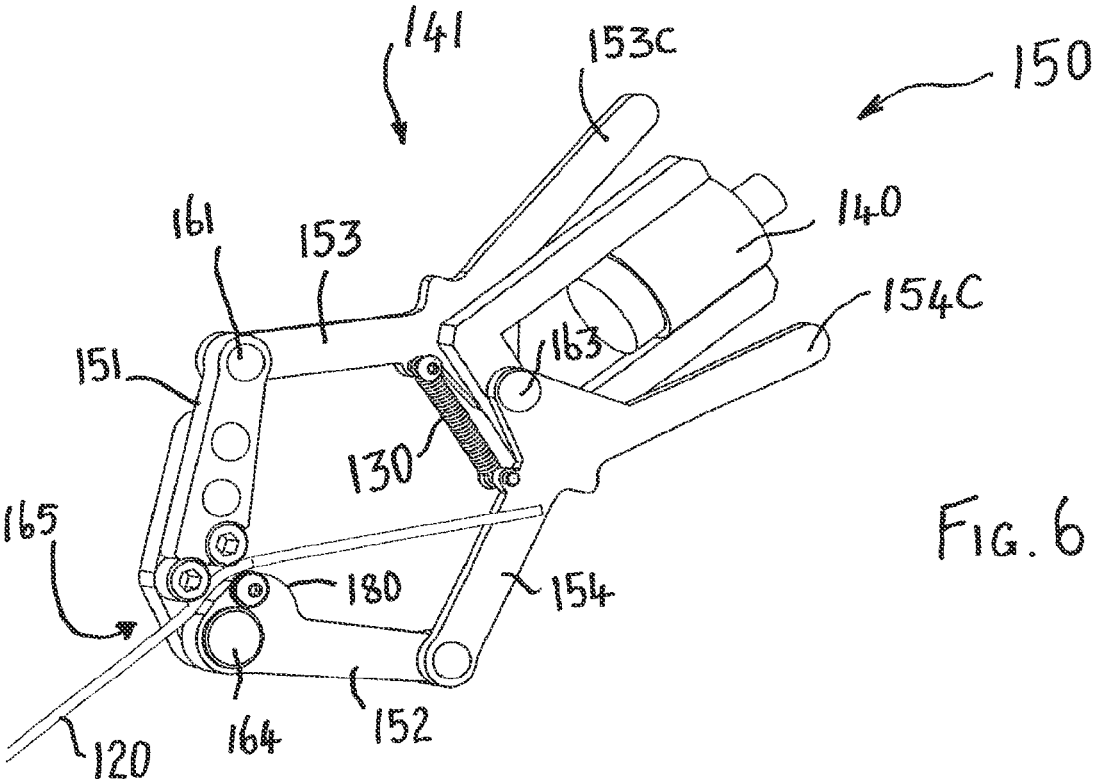
FIG. 6 illustrates one side of a first wire clamp of the preferred embodiment.
Figure 7:
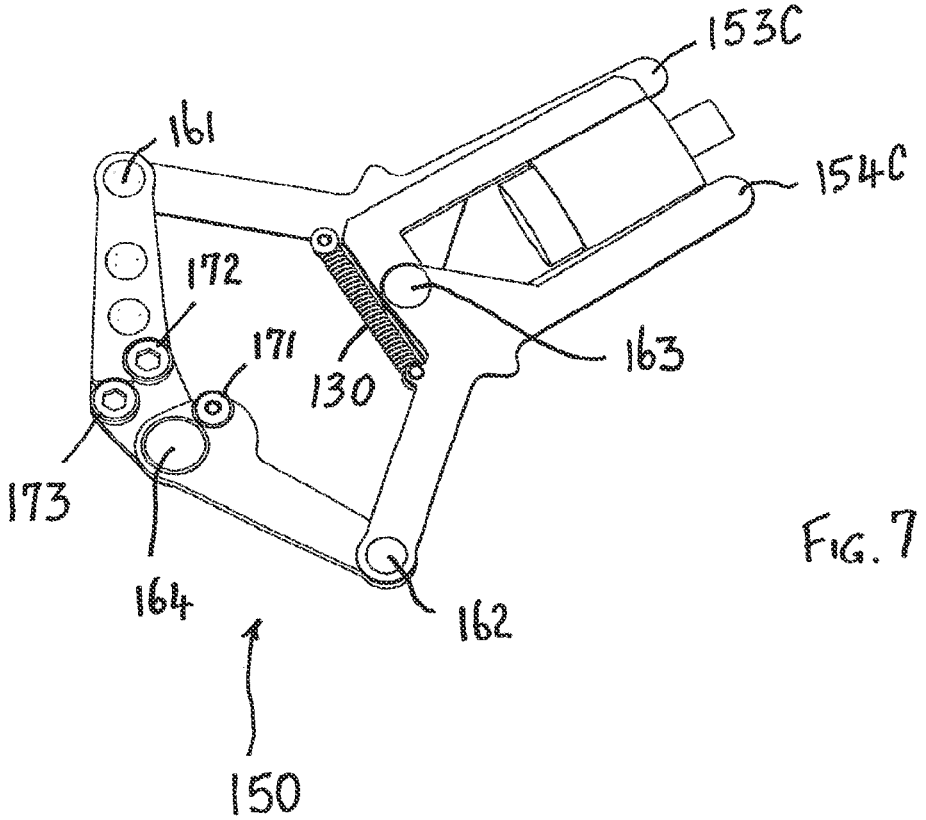
FIG. 7 illustrates the same side of the first wire clamp of FIG. 6 but with the clamp open.
Figure 8:
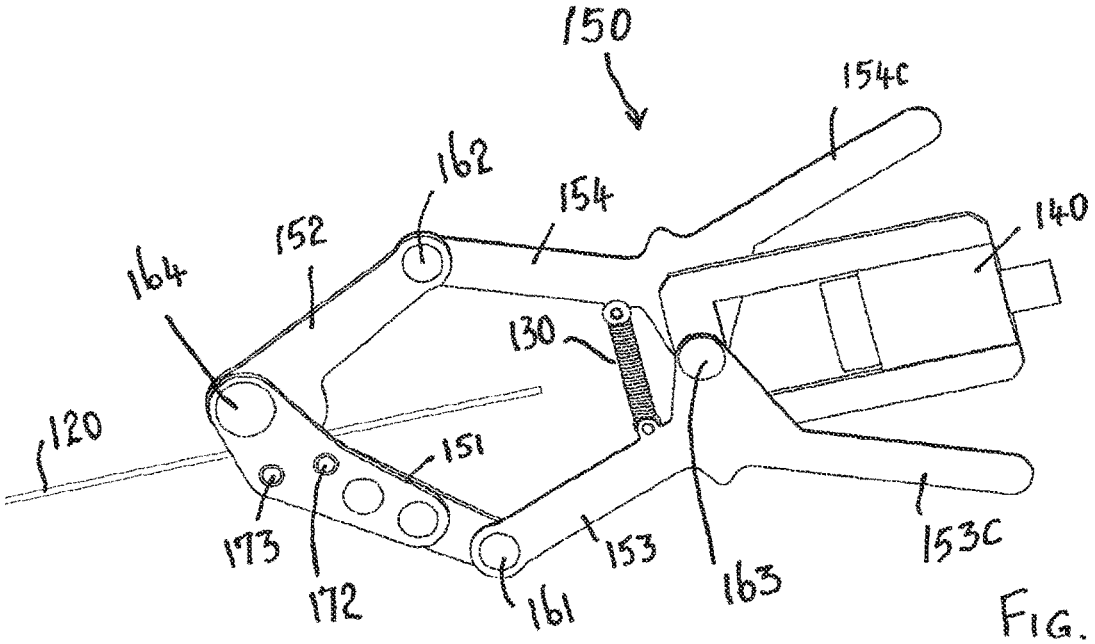
FIG. 8 illustrates the other side of the clamp of FIG. 6 with the clamp closed.
Figure 9:
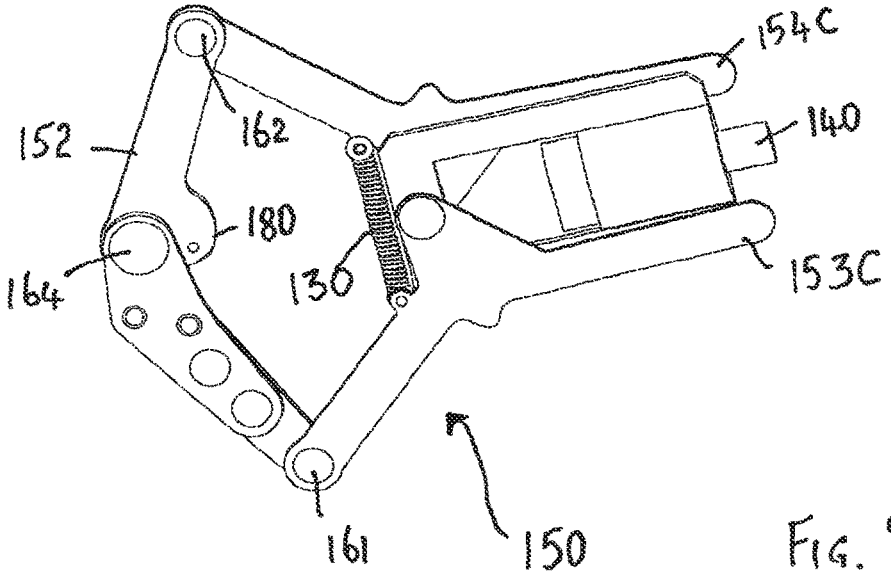
FIG. 9 illustrates the other side of the clamp of FIG. 7 with the clamp open.

As best seen in FIG. 6, the tension spring 130 urges the proximal arms 153, 154 towards each other and thereby closes the gripping jaws 165. This enables the gripping jaws to be connected to a fencing wire 120 and clamped thereto by the spring 130. The arm extensions 153C and 154C function like the handles of a pair of pliers and enable a gloved hand to grip these and bring them together, thereby opening the gripping jaws 165 as illustrated in FIG. 7. Thus the desirable function of enabling the gripping jaws to be releasably clamped to the fencing wire 120 is achieved. However, since the strain is transmitted through the arms 151-154 only, there is no spring to partially absorb the tension of the wire as in the prior art referred to above.

As best seen in FIGS. 7 and 11, the gripping jaws 165 are preferably formed from socket head cap screws. One of these screws 171 is provided on the distal arm 152 adjacent the pivot 164. A spaced apart pair of these screws 172, 173 is located on the distal arm 151 and spaced apart so as to form a bight 174. As seen in FIG. 6 the socket head cap screw 171 enters into the bight 174 when the gripping jaws 165 are clamped onto the wire 120. This temporarily deforms the wire 120 into an approximately part sinusoidal waveform or arc of small amplitude which increases the keying action between the screws 171-173.

The screws 171-173 provide a number of substantial advantages. Firstly, they are provided with a knurled cylindrical surface which readily grips the wire 120. Secondly, the screws 171-173 are commercially available at low cost and are already hardened. Thus the knurled cylindrical surface resists wear. In the event that wear does take place, they can be replaced at low cost. Furthermore, the direction of rotation of the screws 171-173 during their installation can be selected so that the force applied to the screws 171-173 by the wire 120 serves to tighten the screws 171-173.

The foregoing describes only one embodiment of the wire clamp and modifications, obvious to those skilled in the fencing arts, can be made thereto without departing from the scope of the present invention. For example, although the above description and drawings illustrate a socket head cap screw, other parts of fasteners can be used instead. These other fastener parts include a nut, or the head of a bolt. Furthermore, if desired, the cap head screw 172 can have a shallow circular groove in its knurled surface to provide a keeper for the wire and thus prevent the wire from moving during straining.

In another arrangement, the cap head screw 171 can be removed and the wire is forced into the bight formed by the cap head screws 172, 173 by the curved anvil surface 180 of the arm 151.

In yet another arrangement, the cap head screw 171 can be replaced by a button head screw or by a rivet.

Turning now to FIGS. 12-16, a second embodiment of the wire clamp or wire gripper 250 is illustrated in which the corresponding portions to the wire clamp 150 have a designation number increased by 100. Thus the same parallelogram arrangement is formed by four arms 251-254. The spring 230 is mounted by means of hooks retained in slots rather than by rivets as was previously the case. In addition, the distal arm 152 is fabricated as a single cranked portion rather than from two pieces as previously.

The invention claimed is:

1. A parallelogram wire gripping apparatus for use in wire straining, said apparatus comprising a pair of distal arms and a pair of proximal arms, the distal ends of the distal arms being pivoted to each other and shaped to form a wire clamp, each proximal end of the distal arms being pivoted to a corresponding distal end of the proximal arms, each proximal arm being pivoted together at a midpoint thereof, a spring interconnecting said proximal arms at a location intermediate said distal ends of said proximal arms and said midpoints, and urging said wire clamp closed, and said proximal arms extending beyond said midpoints in opposite directions to form a pair of graspable plier-like handles which when moved against the action of said spring opens said wire clamp.

2. The apparatus as claimed in claim 1 wherein said spring is a helical tension spring.

3. The apparatus as claimed in claim 1 wherein that portion of each said proximal arm which extends beyond said midpoints is curved.

4. The apparatus as claimed in claim 1 wherein one of said distal arms is kinked or cranked.

5. A wire gripping jaws apparatus for holding a wire during straining, said apparatus comprising a pair of arms pivoted together and movable to clamp and un-clamp a length of wire, wherein one of said arms has a pair of spaced apart first fastener parts secured thereto and forming a bight opposite the other of said arms, whereby said arms are movable to position said wire between said first fastener parts and thereby clamp said wire in said bight.

6. The apparatus as claimed in claim 5 wherein the other one of said arms has a curved portion which forms an anvil to drive said wire into said bight.

7. The apparatus as claimed in claim 5 wherein the other one of said arms has a second fastener part which drives said wire into said bight.

8. The apparatus as claimed in claim 5 wherein said fastener parts are substantially cylindrical.

9. The apparatus as claimed in claim 8 wherein the external surface of said fastener parts is knurled.

10. The apparatus as claimed in claim 5 wherein said fastener parts are hardened.

11. The apparatus as claimed in claim 5 wherein said fastener parts are selected from the class consisting of socket head cap screws, nuts and bolt heads.

12. A fence strainer incorporating at least one of the parallelogram wire gripping apparatus as claimed in claim 1.

13. A fence strainer incorporating at least one wire gripping jaws apparatus as claimed in claim 5.

* * * * *